United States Patent [19]

Stepniak

[11] 4,082,405

[45] Apr. 4, 1978

[54] LOADBREAK MALE CONTACT ASSEMBLY

[75] Inventor: Frank M. Stepniak, Long Valley, N.J.

[73] Assignee: Amerace Corporation, New York, N.Y.

[21] Appl. No.: 712,387

[22] Filed: Aug. 6, 1976

[51] Int. Cl.[2] ..... H01R 13/52

[52] U.S. Cl. ..... 339/111; 200/51 R; 339/DIG. 3; 339/117 R; 339/143 R

[58] Field of Search ..... 339/111, 46, 94 C, 91 R, 339/60 C, 60 R, 143 R, 117 R, DIG. 3; 200/51 R, 149 A

[56] References Cited

U.S. PATENT DOCUMENTS 4,008,943 2/1977 Flatt et al. ..... 339/111

*Primary Examiner*—Roy Lake

*Assistant Examiner*—DeWalden W. Jones

*Attorney, Agent, or Firm*—S. Michael Bender; Ken Richardson

[57] ABSTRACT

A male contact assembly for high voltage switching applications includes an elongate male contact with an electrically conductive extension arranged concentrically with the contact and extending longitudinally therefrom. A layer of electrically insulative material overlies the contact extension and arc-quenching material overlies such electrically insulative layer. The electrically insulative layer is more resilient than both the extension and arc-quenching material whereby the assembly can withstand greater cantilever stressing prior to fracture of the arc-quenching material than an assembly lacking such resilient layer. On such fracturing, the electrically insulative layer isolates the contact extension and contact from electrical arcing.

10 Claims, 4 Drawing Figures

LOADBREAK MALE CONTACT ASSEMBLY

FIELD OF THE INVENTION

This invention relates to electrical connectors and more particularly to contact assemblies for use in high voltage switching applications.

BACKGROUND OF THE INVENTION

In the underground power distribution industry, elastomeric elbows and bushings have seen more than a decade of commercial usage as separable connector elements. Such elbows typically comprise housings with an electrically stress-graded end interfittable with a shielded power cable and an opposite end having an elongate cylindrical contact assembly electrically connected to the cable conductor and receivable by a female contact in the bushing. The bushing contact is in turn electrically connected to user apparatus, for example, a transformer or the like. In adapting the elbow-bushing separable connector to usage in electric arcing situations, i.e., loadmake, loadbreak and fault closure conditions, the elbow contact assembly is generally comprised of an electrically conductive contact (rod) and a rod extension (follower) of material adapted to generate arc-extinguishing gases upon being exposed to electric arching. In turn, the bushing female contact is combined with a block of like arc-extinguishing material.

For safety in the joinder and separation of elbows and bushings under energized circuit conditions, the industry has adopted the so-called "hot-stick" technique, whereby an operator engages the elbow by use of an elongate stick of some ten foot length and thereby moves the elbow into or away from the bushing. With such distance involved, it is unavoidable that occasions arise wherein there is substantial cantilever stressing of the composite rod and rod extension, i.e., where the hot-stick is not axially in alignment with the bushing female contact element. The rod, being of metal, readily accommodates such cantilever stressing. On the other hand, the rod extension, being constituted of non-metallic arc-quenching material, has quite limited resistance to cantilever stress and has been observed to exhibit cracking. In lessening cracking of arc-quenching material upon cantilever stressing thereof, the industry has in the past reinforced the arc-quenching material by running a rigid extension of the rod interiorly of the arc-quenching material for a portion of its length. In these initial embodiments, the art provided such improved cantilever stress resistance by running a rigid electrically conductive (metal pin) member from the male contact to a location axially interior of the extremity of the arc-quenching material, thereby also providing electrical stress relief for the interface of the rod and rod follower.

In a more recent development, set forth in U.S. Pat. No. 3,955,874, it is proposed that the foregoing metal pin member practice is not adequate in that the follower remains susceptible to breakage in its extent axially beyond the pin member. In accommodating its proposed solution to the problem, the effort in such patent provides a solid electrically insulative member of rigid nature extending the full length of the rod follower and includes, for purposes of stress relief, an electrically conductive film on the exterior of such rigid insulative member extending less than the extent of the follower.

While the proposal of the U.S. Pat. No. 3,955,874 may provide full-length rigidity for followers, along with suitable extension of electrical conductivity, longitudinally outwardly of the male contact, it is considered not to be without disadvantage. Thus, on the development of cracks in the extent of the follower overlying the film, the film provides direct electrical connection to the male contact, whereby an electric arc has electrical access to the male contact, diminishing arc-extinction possibilities.

Additionally, the follower reinforcement element runs the full length thereof and occupies contact assembly volume at the follower end face which otherwise would be occupied by arc-quenching material.

SUMMARY OF THE INVENTION

An object of the present invention is to provide an improved contact assembly for use in high voltage switching applications.

It is a further object of the invention to provide improved cantilever stress resistance in a contact assembly of type wherein a rod follower reinforcing member is longitudinally recessed from the rod follower end face.

It is an additional object of the invention to provide contact assemblies, of type having a contact element, an electrically conductive extension thereof and arc-quenching material radially outwardly of the extension, with electrical isolation of the contact element on occurrences of cracking of the arc-quenching material.

In attaining the foregoing and other objects, the invention provides, in a contact assembly of the above-described type, an intermediate layer disposed radially between the contact element extension and the arc-quenching material more resilient than both the contact extension and the arc-quenching material. Based on such intermediate layer resiliency, the assembly is found to tolerate greater cantilever loading prior to cracking of arc-quenching material than in the case of an assembly lacking the resilient layer. Also, such layer survives fracturing of the arc-quenching material, i.e., does not itself crack, thereby avoiding direct exposure of the contact element extension to an electrical arc striking the arc-quenching material.

The foregoing and other objects and features of the invention will be evident from the following detailed description of preferred embodiments thereof and from the drawings wherein like reference numerals identify like parts throughout.

DESCRIPTION OF PREFERRED EMBODIMENTS AND PRACTICES

Figure 1:
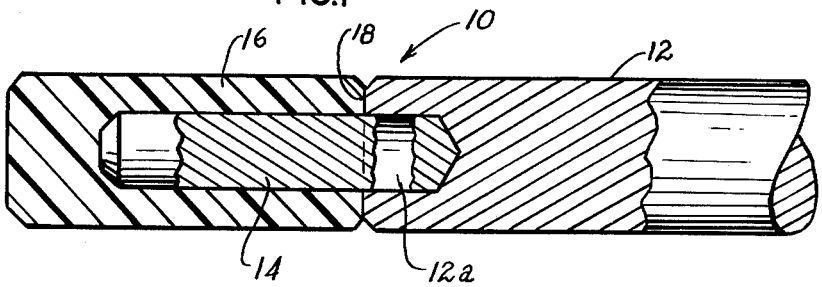
FIGS. 1 and 2 show prior art efforts discussed heretofore, each such figure being a sectional elevation of a male contact assembly.

Referring to FIG. 1, male contact assembly 10, secured to the elbow of the above-discussed elastomeric elbow-bushing connector, includes an elongate male contact element or rod 12 having a rightward extremity (not shown) exteriorly threaded to engage such elbow. Element 12 defines a bore **12*a* concentric therewith and opening into its end distal from such exteriorly threaded extremity for receipt of rod extension 14, comprising an electrically conductive pin-shaped member of lesser diameter than that of cylindrically-shaped element 12**.

In making assembly 10, rod extension 14 is inserted in bore 12*a*, e.g., by press-fitting of the components. Molded on and axially outwardly of extension 14 is follower 16, comprised of material adapted to issue arc-extinguishing gases upon being exposed to an electrical arc struck between assembly 10 and a female contact assembly in such bushing noted above. Materials for constituting the rod, rod extension and follower are commonly known. As alluded to heretofore, the FIG. 1 structure has cantilever strength evidently beyond that of a contact assembly of type dispensing with rod extension 14 and having the rod and follower axially abutting diametrically throughout joinder line 18. Also, extension 14 is effective to extend the electrically conductive continuity of the assembly axially beyond such joinder line 18, providing improved electrical stress relief.

Figure 2:
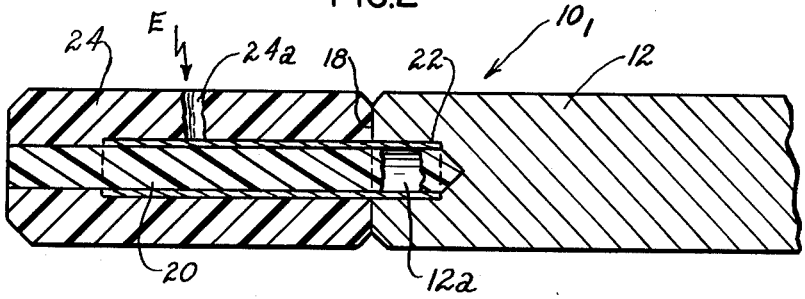
PRIOR ART FIG.2

FIG. 2 shows a male contact assembly $\mathbf{10}_1$ of the type shown in the above-referenced U.S. Pat. No. 3,955,874 wherein an electrically insulative extension 20 is disposed in the bore 12*a* of rod 12 and is encircled therein by electrically conductive film 22. Rod extension 20 will be seen to run the full axial extent of follower 24, i.e., from abutment line 18 to the leftward contact assembly extremity, with film 22 (0.01 mm in radial thickness) extending outwardly longitudinally of joinder line 18 in encircling relation to rod extension 20. As will be seen in FIG. 2 at presumed fissure 24*a* in follower 24, which may be occasioned by cantilevel stressing of the contact assembly, coating 22 is directly exposed to electrical arc E impinging upon the contact assembly. With these presumed conditions, a path of electrical conductivity exists directly through to contact element 12.

Figure 3:
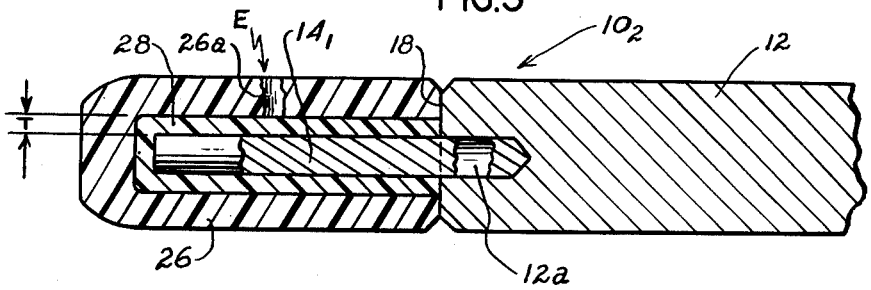
FIGS. 3 and 4 are sectional elevataions of male contact assemblies in accordance with the invention.

In the FIG. 3 embodiment of the invention, male contact assembly $\mathbf{10}_2$ supports, in bore 12*a* of its male contact 12, electrically conductive rigid pin member $\mathbf{14}_1$. Member $\mathbf{14}_1$ extends longitudinally outwardly (leftwardly) of contact 12, but is longitudinally recessed from the follower leftward end face, as in the case of pin member 14 of FIG. 1. Member $\mathbf{14}_1$ supports an outer layer (follower) 26, comprised of arc-quenching material and being generally ogive-shaped at its leftward end face. In intervening relation to layer 26 and pin member $\mathbf{14}_1$ is a layer 28 of electrically insulative material having lesser susceptibility to fracture, upon cantilever stressing of assembly $\mathbf{10}_2$, than outer layer 26. Accordingly, upon fracture of layer 26, as at 26*a*, layer 28 electrically isolates electrically conductive pin member $\mathbf{14}_1$ from electric arc E impinging on follower 26.

With layer 28 having more resiliency, e.g., greater radial compressibility, than both pin member $\mathbf{14}_1$ and follower 26, it is observed that assembly $\mathbf{10}_2$ exhibits a lesser degree of fracture of its arc-quenching layer 26 than does layer 16 of FIG. 1 for the same cantilever loading thereof. It is believed that one or both of two mechanisms are responsible for this improvement. On the one hand, it is considered that member $\mathbf{14}_1$ and layer 26 may have relative movement, radially and otherwise angularly of the longitudinal axis of the assembly, upon cantilever loading of the assembly. On the other hand, it is considered that intermediate layer 28, may serve to reduce the residual mechanical stresses which otherwise would result from different thermal expansion of member $\mathbf{14}_1$ and layer 26 during molding of the latter on the former.

In making the assembly of FIG. 3, layer 28 is applied to member $\mathbf{14}_1$ by molding techniques, dipping, etc., desirably to a minimum thickness (T) of 0.2 millimeter, an order of magnitude different from the electrically conductive film of the referenced FIG. 2 prior art embodiment. As noted in FIG. 3, such molding, dipping or like operation provides for effective encasement of member $\mathbf{14}_1$ by layer 28 throughout the surface area of member $\mathbf{14}_1$ exterior to rod 12.

Figure 4:
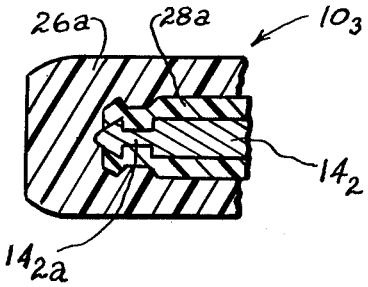

In the FIG. 4 embodiment of the invention, contact assembly $\mathbf{10}_3$ has an electrically conductive rod extension $\mathbf{14}_2$ defining a notched or reduced diameter portion $\mathbf{14}_2$*a*. In this arrangement, electrically insulative layer 28*a* is preferably a heat-shrinkable tube, heat shrunk onto member $\mathbf{14}_2$. Following forming of this subassembly, arc-quenching material outer layer 26*a* is molded thereupon. Notched portion $\mathbf{14}_2$ is effective to sustain layers 26*a* and 28*a* against mechanical separation of these layers from supporting rigid member $\mathbf{14}_2$. Such heat-shrinkable tube may be, for example, a product commercially available from the Alfa Wire Corporation, with product designation FIT-221-$\frac{3}{8}$. The FIG. 3 encasement practice may be achieved by employing a heat-shrinkable tube having one end thereof closed. Where layer 28 or layer 28*a* is of molded variety, the molded material may be comprised of a natural synthetic rubber, such as EPDM, SBR, etc. The material for contact 12 may be a telurium copper alloy with rods $\mathbf{14}_1$ and $\mathbf{14}_2$ being comprised of stainless steel. Followers 26 and 26*a* may have outer diameters of $\frac{1}{2}$ inch and rods $\mathbf{14}_1$ and $\mathbf{14}_2$ may have outer diameters of $\frac{1}{4}$ inch with layer 28, as noted above, having a minimum thickness of two-tenths of a millimeter.

Assemblies in accordance with the invention exhibit lesser severity of cracking of arc-quenching material upon being subjected to both drop-testing and cantilever loading as against the prior art assembly of FIG. 1 also of type having its rod follower reinforcing member longitudinally recessed from the rod follower end face. In the drop-testing, contact assemblies are dropped by hand onto a concrete pad from a waist-high level and are also dropped through an eight foot pipe onto a steel pad. Additionally, the assemblies are impacted by a steel rod dropped thereon through such pipe. In cantilever loading, loads are applied transversely of the longitudinal axis of the assemblies, with loading increased stepwise until cracking of the arc-quenching material occurs in various degrees.

Various changes and modifications made as will be evident to those skilled in the art may be introduced in the foregoing embodiments and practices without departing from the invention. Thus, the particularly illustrated embodiments and disclosed practices are intended in an illustrative and not in a limiting sense. The true spirit and scope of the invention is set forth in the following claims.

What is claimed is:

1. A male contact assembly comprising:

(a) an elongate male contact of electrically conductive material;

(b) an electrically conductive member secured to said male contact and extending longitudinally therefrom;

(c) an outer layer comprised of material generating arc-extinguishing gases upon exposure to electrical arcing; and (d) an intermediate layer situate between said conductive member and said outer layer of greater resiliency than said outer layer; and (e) wherein said outer layer extends longitudinally beyond said male contact to a greater extent than said intermediate layer.

2. The male contact assembly claimed in claim 1 wherein said intermediate layer and said conductive member extend longitudinally from said male contact to a lesser extent that said outer layer.

3. The male contact assembly claimed in claim 2 wherein the minimum thickness of said intermediate layer is two-tenths of a millimeter.

4. A male contact assembly comprising:

(a) an elongate cylindrical male contact of electrically conductive material;

(b) a pin member of electrically conductive material secured to said male contact and extending longitudinally therefrom;

(c) a layer of electrically insulative material overlying said pin member and extending longitudinally thereon; and (d) an outer layer overlying such electrically insulative layer and extending longitudinally beyond said pin member, said outer layer being comprised of material generating arc-extinguishing gases upon exposure to electrical arcing, wherein the longitudinal extent of said electrically insulative layer is less than the longitudinal extent of said outer layer.

5. The male contact assembly claimed in claim 4 wherein said layer of electrically insulative material is constituted by a heat-shrunk tubular member encircling said pin member.

6. A male contact assembly claimed in claim 4 wherein said layer of electrically insulative material is constituted by a molded member encasing said pin member.

7. The male contact assembly claimed in claim 4 wherein said male contact defines an interior bore and said pin member defines an extension seatable in said male contact bore.

8. The male contact assembly claimed in claim 4 wherein said layer of electrically insulative material is of such material composition and thickness as to enable movement of said pin member and said outer layer transversely of the pin member longitudinal axis.

9. The male contact assembly claimed in claim 4 wherein said layer of electrically insulative material has thickness of at least two-tenths of a millimeter.

10. The male contact assembly claimed in claim 4 wherein said pin member has a reduced diameter section between opposed larger diameter ends thereof.

* * * * *